US006203583B1

(12) United States Patent
Botros

(10) Patent No.: US 6,203,583 B1
(45) **Date of Patent: *Mar. 20, 2001**

(54) COLD FLOW IMPROVERS FOR DISTILLATE FUEL COMPOSITIONS

(75) Inventor: Maged G. Botros, West Chester, OH (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/311,459

(22) Filed: May 13, 1999

(51) Int. Cl.[7] ..... C10L 1/18; C10L 1/22

(52) U.S. Cl. ..... 44/347; 44/351; 44/394; 44/395

(58) Field of Search ..... 44/347, 351, 331, 44/393, 394, 395

(56) References Cited

U.S. PATENT DOCUMENTS

| | | | | |
|---|---|---|---|---|
| 2,620,308 | | 12/1952 | Steward | 252/52 |
| 2,965,678 | | 12/1960 | Sunberg et al. | 260/615 |
| 2,977,344 | | 3/1961 | Zopf et al. | 260/27 |
| 3,048,479 | | 8/1962 | Ilnyckyj et al. | 44/62 |
| 3,231,498 | * | 1/1966 | de Vries | 44/351 |
| 3,250,599 | | 5/1966 | Kirk et al. | 44/62 |
| 3,382,056 | * | 5/1968 | Mehmedbasich | 44/351 |
| 3,444,082 | | 5/1969 | Kautsky | 252/51.5 |
| 3,462,249 | | 8/1969 | Tunkel | 44/62 |
| 3,471,458 | | 10/1969 | Mehmedbasich | 260/78.5 |
| 3,560,456 | | 2/1971 | Hazen et al. | 260/78.5 |
| 3,620,696 | | 11/1971 | Hollyday et al. | 44/62 |
| 3,694,176 | | 9/1972 | Miller | 44/62 |
| 3,854,893 | | 12/1974 | Rossi | 44/62 |
| 3,966,428 | | 6/1976 | Rossi | 44/62 |
| 4,151,069 | | 4/1979 | Rossi | 208/33 |
| 4,178,950 | * | 12/1979 | Sweeney | 44/393 |
| 4,178,951 | * | 12/1979 | Sweeney | 44/393 |
| 4,240,916 | | 12/1980 | Rossi | 252/56 |
| 4,402,845 | | 9/1983 | Zoleski et al. | 252/52 |
| 4,746,327 | | 5/1988 | Smyser | 44/62 |
| 4,862,908 | * | 9/1989 | Payer | 44/393 |
| 4,863,486 | | 9/1989 | Tack et al. | 44/62 |
| 4,882,034 | | 11/1989 | Tack et al. | 208/15 |
| 4,900,332 | | 2/1990 | Denis et al. | 44/62 |
| 4,919,685 | * | 4/1990 | Herbstman et al. | 44/347 |
| 4,932,980 | * | 6/1990 | Mueller | 44/393 |
| 4,985,048 | | 1/1991 | Wirtz et al. | 44/394 |
| 5,011,505 | | 4/1991 | Lewtas et al. | 44/393 |
| 5,189,231 | | 2/1993 | Canova et al. | 585/4 |
| 5,256,166 | * | 10/1993 | Fischer | 44/393 |
| 5,525,128 | | 6/1996 | McAleer et al. | 44/459 |
| 5,588,973 | * | 12/1996 | Blackborow | 44/331 |
| 5,681,359 | * | 10/1997 | Botros | 44/393 |
| 5,766,273 | * | 6/1998 | Dralle-Voss et al. | 44/393 |

FOREIGN PATENT DOCUMENTS

| | | |
|---|---|---|
| 0 254 284 A1 | 1/1988 | (DE) . |
| 0 030 099 A1 | 10/1981 | (EP) . |
| 0196217 A2 | 1/1986 | (EP) . |
| 0 654 526 A2 | 5/1995 | (EP) . |
| 1245879 | 8/1971 | (GB) . |
| 1374051 | 11/1974 | (GB) . |
| 1 593 672 | 7/1981 | (GB) . |
| 046096 | 5/1981 | (JP) . |
| 072942 | 12/1981 | (JP) . |
| 117188 | 12/1986 | (JP) . |
| 249860 | 5/1987 | (JP) . |

OTHER PUBLICATIONS

Hihara et al., 91:213717e Fuel Oil Compositions, Chemical Abstracts, vol. 91, 1979.
Hihara et al., 91:195808d Fuel Oil Compositions, Chemical Abstracts, vol. 91, 1979.
Nishikawa, et al., 92:200767s Fuel Oil Compositions, Chemical Abstracts, vol. 91, 1979.

* cited by examiner

*Primary Examiner*—Margaret Medley
(74) *Attorney, Agent, or Firm*—Shao Guo

(57) ABSTRACT

An additive combination for distillate fuels and a fuel composition having improved cold flow properties. The additive combination is incorporated into a major proportion of distillate fuel and is comprised of an ethylene vinyl acetate isobutylene terpolymer in combination with one or more of a maleic anhydride α-olefin copolymer component, a polyimide component, and an alkyl phenol component each having one or more hydrocarbon substituents within specified carbon number ranges. Optionally, an ethylene vinyl acetate copolymer may also be incorporated as a component therein.

25 Claims, No Drawings

COLD FLOW IMPROVERS FOR DISTILLATE FUEL COMPOSITIONS

FIELD OF THE INVENTION

This invention relates to fuel additives which are useful as cold flow improvers and fuel compositions incorporating these additives.

BACKGROUND OF THE INVENTION

Distillate fuels such as diesel fuels tend to exhibit reduced flow at reduced temperatures due in part to formation of solids in the fuel. The reduced flow of the distillate fuel affects the transport and use of the distillate fuels not only in the refinery but also in an internal combustion engine. If the distillate fuel is cooled to below a temperature at which solid formation begins to occur in the fuel, generally known as the cloud point (ASTM D 2500) or wax appearance point (ASTM D 3117), solids forming in the fuel in time will essentially prevent the flow of the fuel, plugging piping in the refinery, during transport of the fuel, and in inlet lines supplying an engine. Under low temperature conditions during consumption of the distillate fuel, as in a diesel engine, wax precipitation and gelation can cause the engine fuel filter to plug which can be simulated in the laboratory with tests such as cold filter plugging point. In addition to contributing to filter plugging, gelation of the fuel may also cause flow problems which can be evaluated by a pour point test method, published as ASTM D 97. A test container of fuel is cooled in a bath and the container is periodically removed to determine if the fuel flows. The test is completed when the fuel fails to move when the container is held horizontally for 5 seconds. Fuel movement at this point is prevented by the formation of an interlocking wax structure; as little as 2% wax out of solution can prevent flow of the remaining 98% liquid fuel.

As used herein, distillate fuels encompass a range of fuel types, typically including but not limited to kerosene, intermediate distillates, lower volatility distillate gas oils, and higher viscosity distillates. Grades encompassed by the term include Grades No. 1-D, 2-D and 4-D for diesel fuels as defined in ASTM D 975. The distillate fuels are useful in a range of applications, including use in automotive diesel engines and in non-automotive applications under both varying and relatively constant speed and load conditions.

The cold flow behavior of a distillate fuel such as diesel fuel is a function of its composition. The fuel is comprised of a mixture of hydrocarbons including normal paraffins, branched paraffins, olefins, aromatics and other non-polar and polar compounds. As the diesel fuel temperature decreases at the refinery, during transport, storage, or in a vehicle, one or more components of the fuel will tend to separate, or precipitate, as a wax.

The components of the diesel fuel having the lowest solubility tend to be the first to separate as solids from the fuel with decreasing temperature. Straight chain hydrocarbons, such as normal paraffins, typically have the lowest solubility in the diesel fuel. Generally, the paraffin crystals which separate from the diesel fuel appear as individual crystals. As more crystals form in the fuel, they ultimately create a network in the form of a gel to eventually prevent the flow of the fuel.

It is known to incorporate additives into diesel fuel to enhance the flow properties of the fuel at low temperatures. These additives are generally viewed as operating under either or both of two primary mechanisms. In the first, the additive molecules have a configuration which allows them to interact with the n-paraffin molecules at the growing ends of the paraffin crystals. The interacting additive molecules by steric effects act as a cap to prevent additional paraffin molecules from adding to the crystal, thereby limiting the dimensions of the existing crystal. The ability of the additive to limit the dimensions of the growing paraffin crystal is evaluated by low temperature optical microscopy or by the pour point depression (PPD) test, ASTM D 97, discussed generally above.

In the second mechanism, the flow modifying additive may improve the flow properties of diesel fuel at low temperatures by functioning as a nucleator to promote the growth of smaller size crystals. This modified crystal shape permits improved flow by altering the n-paraffin crystallization behavior, which is normally evaluated by tests such as the Cold Filter Plugging Point (CFPP) Test, IP 309.

Additional, secondary, mechanisms involving the modification of wax properties in the fuel by incorporation of additives include, but are not limited to, dispersal of the wax in the fuel and solubilization of the wax in the fuel.

The range of available diesel fuels includes Grade No. 2-D, defined in ASTM D 975 as a general purpose, middle distillate fuel for automotive diesel engines, which is also suitable for use in non-automotive applications, especially in conditions of frequently varying speed and load. Certain of these Grade No. 2-D (No. 2) fuels may be classified as being hard to treat when using one or more additives to improve flow. A hard-to-treat diesel fuel is either unresponsive to a flow improving additive, or requires increased levels of one or more additives relative to a normal fuel to effect flow improvement.

Fuels in general, and diesel fuels in particular, are mixtures of hydrocarbons of different chemical types (i.e., paraffins, aromatics, olefins, etc.) wherein each type may be present in a range of molecular weights and carbon lengths. Resistance to flow is a function of one or more properties of the fuel, the properties being attributed to the composition of the fuel. For example, in the case of a hard-to-treat fuel the compositional properties which render a fuel hard to treat relative to normal fuels include a narrower wax distribution; the virtual absence of very high molecular weight waxes, or inordinately large amounts of very high molecular weight waxes; a higher total percentage of wax; and a higher average normal paraffin carbon number range. It is difficult to generate a single set of quantitative parameters which define a hard-to-treat fuel. Nevertheless, some of the measured parameters which tend to identify a hard-to-treat middle distillate fuel include a temperature range of less than 100° C. between the 20% distilled and 90% distilled temperatures (as determined by test method ASTM D 86), a temperature range less than 25° C. between the 90% distilled temperature and the final boiling point (see ASTM D 86), and a final boiling point above or below the temperature range 360° to 380° C.

Hard-to-treat fuels are particularly susceptible to cold flow impairment due to the composition of the fuel. In a hard-to-treat fuel a large quantity of wax tends to settle at a faster rate. As a result, attachments form irregularly on the face of the crystal and increase the difficulty for a flow improver to arrest growth.

There continues to be a demand for additives which improve the flow properties of distillate fuels. Further, there remains a need for additive compositions which are capable of improving the flow properties of hard-to-treat fuels.

SUMMARY OF THE INVENTION

It has been found that ethylene vinyl acetate isobutylene terpolymer combined with either certain imide or maleic anhydride olefin copolymer additives with at least a minimum concentration by weight of substituents on the additives having a specified range of carbon chain lengths, alone or in combination with alkyl phenols having a specified range of carbon chain lengths, and optionally an ethylene vinyl acetate copolymer, will significantly improve the cold flow properties of certain distillate fuels such as No. 2 diesel fuel beyond what is expected from the terpolymer alone or from other ethylene vinyl acetate-based cold flow improvers. It has been found in addition that ethylene vinyl acetate isobutylene terpolymer combined with certain alkyl phenol additives and optionally an ethylene vinyl acetate copolymer will also significantly improve the cold flow properties of certain distillate fuels such as No. 2 diesel fuel.

Copending application Ser. No. 09/311,465 filed on the same date herewith is directed to certain maleic anhydride αolefin copolymer and its imide additives incorporated into distillate fuel to improve the wax anti-settling properties of the fuel.

The ethylene vinyl acetate isobutylene terpolymer component has a weight average molecular weight in the range of about 1,500 to about 18,000, preferably about 3,000 to about 12,000, a number average molecular weight in the range of about 400 to about 3,000, preferably about 1,500 to about 2,500 and a ratio of weight average molecular weight to number average molecular weight from about 1.5 to about 6. The terpolymer is combined with one or more additional additive components to produce the additive combination of the invention.

The maleic anhydride olefin copolymer additive component is prepared by the reaction of maleic anhydride with α-olefin. Generally this copolymer additive contains substantially equimolar amounts of maleic anhydride and α-olefin. The operative starting α-olefin is a mixture of individual α-olefins having a range of carbon numbers. The starting α-olefin composition used to prepare the maleic anhydride olefin copolymer additive component of the invention has at least a minimum α-olefin concentration by weight with a carbon number within the range from about $C_{16}$ to about $C_{40}$. The additive component generally contains blends of α-olefins having carbon numbers within this range. The operative starting α-olefin may have a minor component portion which is outside the above carbon number range. The maleic anhydride α-olefin copolymers have a number average molecular weight in the range of about 1,000 to 5,000 as measured by vapor pressure osmometry.

The imide additive component is prepared by the reaction of an alkyl amine, maleic anhydride and α-olefin. Generally the imide is produced from substantially equimolar amounts of maleic anhydride and α-olefin. The operative α-olefin has at least a minimum α-olefin concentration by weight with a carbon number within the range from about $C_{20}$ to $C_{40}$. Particularly advantageous cold flow improving properties are obtained when the alkyl amine of the imide additive component is tallow amine. The imide has a number average molecular weight in the range of 1,000 to about 8,000 as measured by vapor pressure osmometry.

The alkyl phenol component is primarily monosubstituted phenol, and this substituent is a hydrocarbon with a carbon number within the range of either at least 90% from about $C_{20}$ to about $C_{24}$; or at least 70% from about $C_{24}$ to about $C_{28}$, and preferably at least 80% from about $C_{24}$ to about $C_{28}$.

DETAILED DESCRIPTION OF THE INVENTION

It has been found that unexpectedly advantageous cold flow improving properties can be imparted to distillate fuels by incorporating an additive combination having at least two components, wherein the first component is an ethylene vinyl acetate isobutylene terpolymer and the second component has the following structure:

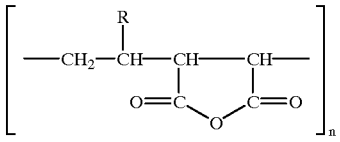

wherein R has at least 60% by weight of a hydrocarbon substituent from about 16 to about 40 carbons, and n is from about 2 to about 8. Preferably R has at least 70% by weight of a hydrocarbon substituent from about 16 to about 40 carbons, and most preferably R has at least 80% by weight of a hydrocarbon substituent from about 16 to about 40 carbons. In a preferred embodiment R has at least 60% by weight of a hydrocarbon substituent with a carbon number range from 22 to 38 carbons, more preferably at least 70% by weight, and most preferably at least 80% by weight. The resulting maleic anhydride α-olefin copolymer component has a number average molecular weight in the range of about 1,000 to about 5,000, as determined by vapor pressure osmometry.

This cold flow improving additive component of the invention typically encompasses a mixture of hydrocarbon substituents of varying carbon number within the recited range, and encompasses straight and branched chain moieties.

It has also been found that an alternate second additive component of the structure:

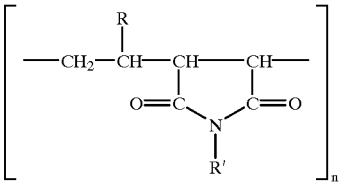

wherein R has at least 60% by weight of a hydrocarbon substituent from about 20 to about 40 carbons, R' has at least 80% by weight of a hydrocarbon substituent from 16 to 18 carbons, and n is from about 1 to about 8, also has cold flow improving properties in combination with the terpolymer. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. Typically, R' has at least 90% by weight of a hydrocarbon substituent from 16 to 18 carbons. The above additive component, described as an imide, has a number average molecular weight by vapor pressure osmometry in the range of about 1,000 to about 8,000.

As with the maleic anhydride α-olefin copolymer component, this imide component typically encompasses a mixture of hydrocarbon substituents of varying carbon number within the recited range, and encompasses straight and branched chain moieties.

It has also been found that yet another alternate second additive component of the structure:

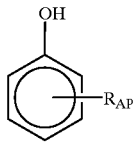

wherein $R_{AP}$ is selected from the group consisting of at least 90% by weight of a hydrocarbon substituent from about 20 to 24 carbons, at least 70% by weight of a hydrocarbon substituent from about 24 to about 28 carbons, and mixtures thereof; also has cold flow improving properties in combination with the terpolymer. As to the higher carbon number substituent, preferably $R_{AP}$ has at least 80% by weight of a hydrocarbon substituent from about 24 to about 28 carbons. Generally, the phenol is at least 70% monosubstituted, and preferably is at least about 80% monosubstituted.

As with the above additive components, this alkyl phenol component typically encompasses a mixture of hydrocarbon substituents of varying carbon number within the recited range, and encompasses straight and branched chain moieties.

It has also been found that additives providing good cold flow properties are prepared from the combination of terpolymer; maleic anhydride α-olefin copolymer or its imide; and either or both of the alkyl phenol materials. Especially good results have been obtained by the further incorporation of an ethylene vinyl acetate copolymer into the additive combination of terpolymer, maleic anhydride α-olefin copolymer and alkyl phenol.

Problems associated with the cold flow of a fuel occurs in dynamic systems, such as in a refinery, fuel transport application, or consumer use. To demonstrate the cold flow improving activity of the additive combinations of the invention, pour point depression (PPD) performance and cold filter plugging point (CFPP) performance were evaluated in connection with various distillate fuels. Included fuels are those considered to be hard to treat.

Useful ethylene vinyl acetate isobutylene terpolymers have a weight average molecular weight in the range of about 1,500 to about 18,000, a number average molecular weight in the range of about 400 to about 3,000, and a ratio of weight average molecular weight to number average molecular weight from about 1.5 to about 6. Preferably the weight average molecular weight ranges from about 3,000 to about 12,000, and the number average molecular weight ranges from about 1,500 to about 2,500. The terpolymers have a Brookfield viscosity in the range of about 100 to about 300 centipoise at 140° C. Typically the Brookfield viscosity is in the range of about 100 to about 200 centipoise. Vinyl acetate content is from about 25 to about 55 weight percent. Preferably the vinyl acetate content ranges from about 30 to about 45 weight percent; more preferably the vinyl acetate content ranges from about 32 to about 38 weight percent. The branching index is from 2 to 15, and preferably 5 to 10. The rate of isobutylene introduction depends on the rate of vinyl acetate introduction, and may range from about 0.01 to about 10 times the rate of vinyl acetate monomer flow rate to the reactor. Useful amounts of the terpolymers range from about 10 to about 1,000 ppm by weight of the fuel being treated. Preferred amounts of terpolymers range from about 25 to about 250 ppm by weight of treated fuel in connection with improving pour point depression, and from about 25 ppm to about 500 ppm by weight of treated fuel in connection with improving cold filter plugging point.

Useful ethylene vinyl acetate copolymers have a weight average molecular weight in the range of about 2,000 to about 10,000, a number average molecular weight in the range of about 1,000 to about 3,000, and a ratio of weight average molecular weight to number average molecular weight from about 1 to about 4. Preferably the weight average molecular weight ranges from about 3,000 to about 5,000, and the number average molecular weight ranges from about 1,500 to about 2,500. The copolymers have a Brookfield viscosity in the range of about 100 to about 250 centipoise at 140° C. Typically the Brookfield viscosity is in the range of about 100 to about 200 centipoise. Vinyl acetate content is from about 25 to about 45 weight percent. Preferably the vinyl acetate content ranges from about 30 to about 40 weight percent. Useful amounts of the copolymers range from about 5 to about 250 ppm by weight of the fuel being treated.

The maleic anhydride α-olefin copolymer or its imide additive components act to improve cold flow when effective amounts are added to distillate fuels in combination with ethylene vinyl acetate isobutylene terpolymer and optionally one or both of alkyl phenol and ethylene vinyl acetate copolymer. Also, the alkyl phenol additive component acts to improve cold flow when effective amounts are added to distillate fuels in combination with ethylene vinyl acetate isobutylene terpolymer and optionally ethylene vinyl acetate copolymer. Useful amounts of maleic anhydride α-olefin copolymer, its imide, alkyl phenol or ethylene vinyl acetate copolymer additive components range from about 0.1 to about 250 ppm by weight of the fuel being treated. Preferred amounts of these additive components to improve cold flow properties range from about 4 to about 100 ppm, and most preferably about 4 to about 25 ppm by weight of treated fuel. Maleic anhydride α-olefin copolymers and their imides used according to the teachings of this invention may be derived from α-olefin products such as those manufactured by Chevron Corporation and identified as Gulftene® 24-28 and 30+Alpha-Olefins, or the like. Additional carbon number ranges of α-olefin may also be incorporated into the final copolymer or its imide additive component, as desired.

The alkyl phenol used in the additive combination is prepared by alkylating phenol by one of several methods known in the art. For example the alkyl phenol is prepared by the reaction of an α-olefin and phenol wherein the reaction product is primarily a monosubstituted alkyl phenol. Because of the nature of the reaction, one carbon on the phenol ring can attach to the α-olefin at the terminal carbon of the olefin, resulting in a substituent on the ring having a straight chain carbon number equal to the carbon number of the olefin. Alternatively, the phenol may migrate down the α-olefin chain, bonding at the second or third carbon, resulting in a shorter chain branch such as a methyl or ethyl-branched hydrocarbon substituent wherein the long-chain portion will be reduced in carbon number from the α-olefin by one or two carbons.

The carbon number for the hydrocarbon substituent of the operative alkyl phenol independent of the point of attachment of phenol to the olefin falls preferably in one of two ranges. The carbon number is either at least 90% from about $C_{20}$ to about $C_{24}$; or at least 70% from about $C_{24}$ to about $C_{28}$, and preferably at least 80% from about $C_{24}$ to about $C_{28}$. Generally, incorporation of the higher carbon number range alkyl phenol produces improved cold flow properties compared to the same weight of the lower carbon number alkyl phenol.

The alkyl phenols used according to the teachings of the invention may be derived from Chevron Corporation α-olefin products identified as Gulftene® 20-24 and 24-28 Alpha-Olefins, or the like.

The cold flow improving additive combinations of this invention may be used in combination with other fuel additives such as corrosion inhibitors, antioxidants, sludge inhibitors, cloud point depressants, and the like.

Operating Examples

The following detailed operating examples illustrate the practice of the invention in its most preferred form, thereby enabling a person of ordinary skill in the art to practice the invention. The principles of this invention, its operating parameters and other obvious modifications thereof, will be understood in view of the following detailed procedure.

In evaluating cold flow performance the additive combinations described below were combined with a variety of diesel fuels at a weight concentration of about 25–500 ppm additive combination in the fuel, preferably 25–250 ppm additive combination in the fuel. In all evaluations herein the additive or additive combination was combined with the fuel from a concentrate. One part of a 1:1 weight mixture of additive and xylene was combined with 19 parts by weight of the fuel to be evaluated to prepare the concentrate. The actual final weight concentration of additive in the fuel was adjusted by varying the appropriate amount of the concentrate added to the fuel. If more than one additive was incorporated into the fuel, individual additive concentrates were mixed into the fuel substantially at the same time.

It has been found that the effectiveness of the maleic anhydride α-olefin copolymer, imide, and alkyl phenol as cold flow improver additive components in combination with terpolymer is related to the structure of the additive component. The α-olefin used in making the above additive components is a mixture of individual α-olefins having a range of carbon numbers. The starting α-olefin used to prepare the maleic anhydride olefin copolymer additive of the invention has at least a minimum concentration by weight which has a carbon number within the range from about $C_{16}$ to about $C_{40}$, and preferably in the range of $C_{24}$ to $C_{40}$. The starting α-olefin used to prepare the imide additive of the invention has at least a minimum concentration by weight which has a carbon number within the range from about $C_{20}$ to about $C_{40}$, and preferably in the range of $C_{24}$ to $C_{40}$. The substituent "R" in the above formulas will have carbon numbers which are two carbons less than the α-olefin length, two of the α-olefin carbons becoming part of the polymer chain directly bonded to the repeating maleic anhydride or imide rings. Generally, α-olefins are not manufactured to a single carbon chain length, and thus the manufactured product will consist of component portions of individual α-olefins of varying carbon chain length. In addition, the substituent "R'" used in the imide cold flow additives will also have a minimum concentration within a range of carbon numbers.

Tallow amine is useful to introduce the R' substituent in connection with imide manufacture, and is generally derived from tallow fatty acid. Thus, the range and percentage of carbon numbers for the components of the tallow amine will generally be those of tallow fatty acid. Tallow fatty acid is generally derived from beef tallow or mutton tallow. Though the constituent fatty acids may vary substantially in individual concentration in the beef tallow or mutton tallow based on factors such as source of the tallow, treatment and age of the tallow, general values have been generated and are provided in the table below. The values are typical rather than average.

TALLOW COMPOSITION TABLE

| | Constituent Fatty Acids (g/100 g Total Fatty Acids) | | | | |
|---|---|---|---|---|---|
| | Saturated | | | Unsaturated | |
| Fat | Myristic ($C_{14}$) | Palmitic ($C_{16}$) | Stearic ($C_{18}$) | Oleic ($C_{18:1}$) | Linoleic ($C_{18:2}$) |
| Beef Tallow | 6.3 | 27.4 | 14.1 | 49.6 | 2.5 |
| Mutton Tallow | 4.6 | 24.6 | 30.5 | 36.0 | 4.3 |

Source: CRC Handbook of Chemistry and Physics, 74th ed. (1993–1994); p. 7–29.

The fatty acids from beef or mutton tallow can also be hydrogenated to lower the degree of unsaturation. Thus a tallow amine may contain a major portion by weight of unsaturated amine molecules, and alternatively with sufficient hydrogenation treatment may contain virtually no unsaturated amine molecules. Even with variations in tallow amine composition referred to above it is expected that the concentration by weight of hydrocarbon substituents from 16 to 18 carbons will be at least 80% by weight, and typically at least 90% by weight.

The following table lists several maleic anhydride α-olefin copolymer and its imide additive components with their carbon number distributions for the various substituents of the additive components. The percentages by weight of the carbon number ranges for the starting α-olefins were determined by using a Hewlett Packard HP-5890 gas chromatograph with a Chrompack WCOT (wool coated open tubular) Ulti-Metal 10 m×0.53 mm×0.15 μm film thickness column, with an HT SIMDIST CB coating. The sample was introduced via on-column injection onto the column as a solution in toluene. The gas chromatograph was equipped with a hydrogen flame ionization detector. A temperature program was activated to sequentially elute individual isomers. Because two carbons of the α-olefin become part of the polymer chain directly bonded to the repeating maleic anhydride or imide rings, the listed ranges for the "R" substituent shown in Table 1 are two carbons lower than the actual range determined chromatographically. Also, the listed ranges may encompass isomers having the same carbon number.

TABLE 1

| | R Substituent (% By Weight)[2] | | | | | | | | | R' Substituent | | | |
|---|---|---|---|---|---|---|---|---|---|---|---|---|---|
| Additive | $C_{12}$ | $C_{14}$ | $C_{16}$ | $C_{18}$ | $C_{22-26}$ | $C_{28-38}$ | $C_{40-48}$ | $C_{50-58}$ | $C_{60-76}$ | H | $C_{16}$ | $C_{18}$ | n |
| Imide I | — | — | — | — | 12.3 | 58.5 | 15.9 | 10 | 3.3 | — | 26.0[1] | 68.5[1] | 1.13 |
| Maleic Copolymer I | — | — | — | — | 46.4 | 36.3 | 9.6 | 5.9 | 1.8 | — | — | — | 3.52 |

TABLE 1-continued

| Additive | R Substituent (% By Weight)[2] | | | | | | | | | R' Substituent | | | |
|---|---|---|---|---|---|---|---|---|---|---|---|---|---|
| | $C_{12}$ | $C_{14}$ | $C_{16}$ | $C_{18}$ | $C_{22-26}$ | $C_{28-38}$ | $C_{40-48}$ | $C_{50-58}$ | $C_{60-76}$ | H | $C_{16}$ | $C_{18}$ | n |
| Maleic Copolymer II | 33.1 | 0.2 | — | — | 30.9 | 24.2 | 6.4 | 3.9 | 1.2 | — | — | — | 5.88 |
| Maleic Copolymer III | 24.8 | 0.5 | 24.6 | 0.1 | 23.2 | 18.1 | 4.8 | 3.0 | 0.9 | — | — | — | 5.43 |

[1]Average representative figures, based on Tallow Composition Table.
[2]Total weight may not be 100% as a result of the presence of trace amounts of other materials, and rounding for calculation purposes.

The alkyl phenol component was prepared by reacting a phenolic moiety with an α-olefin, such as a Gulftene® Alpha Olefin product from Chevron Corporation, or the like. Two alkyl phenol materials were tested, one derived from reaction of the phenolic moiety with an α-olefin having a range of about 20 to about 24 carbons, and the second from the reaction of the phenolic moiety with an α-olefin having a range of about 24 to about 28 carbons. The composition of these alkyl phenol materials is provided in more detail in Table 2 below.

The alkylation reaction is understood to form primarily alkyl phenols where the phenol attaches to either the unsaturated terminal carbon or the carbon adjacent to the terminal carbon of the α-olefin. Thus the carbon number of the long chain attached to phenol will be the same as the starting α-olefin carbon number, or one carbon less. Further, it is understood that a minor portion of the alkyl phenol has the phenol attached to the α-olefin at the number three carbon, with still substantially fewer attachments of the phenol to the numbers four through six carbons. Nonetheless the total number of carbons attached to the phenolic carbon does not change, regardless of the point of attachment on the olefin chain.

Typically, a substantial portion of the alkyl phenol contains phenol bonded to either the unsaturated terminal carbon of the α-olefin, the number two or the number three carbon. As a result, the hydrocarbon long chain on the alkyl phenol is generally up to two carbons less than the carbon number of the starting α-olefin.

Table 2 below lists the alkyl phenol products used as additive components herein. The percentages by weight of the carbon number ranges for the starting α-olefins used in preparing alkyl phenols I and II below were determined by using a Hewlett Packard HP-5890 gas chromatograph with a Chrompack WCOT UHI-Metal 10 m×0.53 mm×0.15 μm film thickness column, with an HT SIMDIST CB coating. Sample preparation and chromatographic analysis were conducted in the same manner as that for the maleic copolymer and its imide starting α-olefins discussed above.

TABLE 2

| Additive | Substituent (% by Weight)[1] | | | | | | | | | |
|---|---|---|---|---|---|---|---|---|---|---|
| | $C_{18}$ | $C_{20}$ | $C_{22}$ | $C_{24}$ | $C_{26}$ | $C_{28}$ | $C_{30-40}$ | $C_{42-50}$ | $C_{52-60}$ | $C_{62-78}$ |
| Alkyl Phenol I | 0.4 | 50.5 | 36.9 | 11.3 | — | — | — | — | — | — |
| Alkyl Phenol II | — | — | — | 18.3 | 42.6 | 19.6 | 14 | 3.2 | 1.8 | 0.4 |

[1]Total weight may not be 100% as a result of the presence of trace amounts of other materials, and rounding for calculation purposes.

The terpolymers and copolymers utilized in preparing the various additive combinations are characterized in Table 3 set out below.

TABLE 3

| Additive | Viscosity @140° C. (cP) | Vinyl Acetate Content (wt. %) | Mn | Mw | Mw/Mn |
|---|---|---|---|---|---|
| Terpolymer I | 125 | 37 | 2,237 | 11,664 | 5.2 |
| Terpolymer II | 175 | 35.5 | 1,986 | 3,563 | 1.8 |
| Copolymer I | 115 | 32 | 1,889 | 3,200 | 1.69 |
| Copolymer II | 200 | 39 | 2,031 | 4,568 | 2.25 |

Fuels included in the evaluation of the additives are listed below in Table 4, which provides distillation data for the respective fuels according to test method ASTM D 86. The data indicate the boiling point temperature (° C.) at which specific volume percentages of the fuel have been recovered from the original pot contents, at atmospheric pressure.

TABLE 4

| | | Percentage Distilled/Temperature (° C.) | | | | | | | | | | | | |
|---|---|---|---|---|---|---|---|---|---|---|---|---|---|---|
| Fuel | Initial B.P. | 5% | 10% | 20% | 30% | 40% | 50% | 60% | 70% | 80% | 90% | 95% | Final B.P. | % Residue |
| 1 | 186 | 201 | 208 | 226 | 238 | 252 | 263 | 276 | 290 | 307 | 333 | 351 | 364 | 1.0 |
| 2 | 213 | 219 | 224 | 235 | 246 | 256 | 267 | 277 | 288 | 300 | 316 | 327 | 348 | 1.3 |
| 3 | 173 | 198 | 211 | 228 | 241 | 253 | 263 | 273 | 284 | 297 | 313 | 325 | 352 | 0.2 |
| 4 | 179 | 213 | 226 | 243 | 256 | 264 | 272 | 279 | 287 | 297 | 312 | 326 | 340 | 0.5 |
| 5 | 163 | 188 | 197 | 213 | 226 | 238 | 249 | 258 | 268 | 282 | 304 | 327 | 332 | 0.8 |
| 6 | 183 | 217 | 231 | 249 | 262 | 272 | 282 | 292 | 303 | 314 | 336 | 354 | 357 | 0.1 |
| 7 | 167 | 202 | 222 | 244 | 255 | 264 | 274 | 284 | 297 | 310 | 328 | 338 | 367 | 1.6 |
| 8 | 198 | 215 | 224 | 236 | 244 | 251 | 257 | 268 | 277 | 287 | 303 | 311 | 343 | 1.4 |
| 9 | 209 | 220 | 231 | 242 | 252 | 260 | 270 | 278 | 289 | 303 | 321 | 333 | 349 | 1.4 |
| 10 | 206 | 226 | 238 | 253 | 267 | 277 | 288 | 297 | 305 | 317 | 326 | 333 | 379 | 1.2 |
| 11 | 210 | 237 | 246 | 264 | 274 | 284 | 293 | 303 | 311 | 319 | 330 | 337 | 368 | 0.3 |
| 12 | 222 | 239 | 244 | 251 | 260 | 268 | 274 | 283 | 293 | 305 | 332 | 334 | 356 | 0.2 |
| 13 | 186 | 203 | 210 | 224 | 237 | 251 | 269 | 288 | 312 | 339 | 378 | 389 | 397 | 1.1 |
| 14 | 192 | 203 | 213 | 224 | 238 | 248 | 259 | 270 | 282 | 294 | 312 | 326 | 361 | 1.1 |

To evaluate whether the diesel fuels listed in Table 4 would be considered hard to treat, the temperature difference between the 20% distilled and 90% distilled temperatures (90%–20%), and 90% distilled temperature and final boiling point (90%-FBP) were calculated. Also, the final boiling point was included. The data are provided in Table 5. A 90%–20% temperature difference of about 100–120° C. for a middle distillate cut fuel is considered normal; a difference of about 70°–100° C. is considered narrow and hard to treat; and a difference of less than about 70° C. is considered extreme narrow and hard to treat. A 90%-FBP temperature difference in the range of about 25° C. to about 35° C. is considered normal; a difference of less than about 25° C. is considered narrow and hard to treat; and a difference of more than about 35° C. is considered hard to treat. A final boiling point below about 360° C. or above about 380° C. is considered hard to treat. Distillation data were generated by utilizing the ASTM D 86 test method. Additional disclosure on hard-to-treat fuels is found in U.S. Pat. No. 5,681,359, incorporated herein by reference.

TABLE 5

| | Temperature Difference (° C.) | | |
|---|---|---|---|
| Fuel | 90% - 20% | 90% - FBP | FBP(° C.) |
| 1 | 107 | 31 | 364 |
| 2 | 81 | 32 | 348 |
| 3 | 85 | 39 | 352 |
| 4 | 69 | 28 | 340 |
| 5 | 91 | 28 | 332 |
| 6 | 87 | 21 | 357 |
| 7 | 84 | 39 | 367 |
| 8 | 67 | 40 | 343 |
| 9 | 79 | 28 | 349 |
| 10 | 73 | 53 | 379 |
| 11 | 66 | 38 | 368 |
| 12 | 81 | 24 | 356 |
| 13 | 154 | 19 | 397 |
| 14 | 88 | 49 | 361 |

If the fuel met at least one of the above three evaluation parameters, i.e., 90%–20% distilled temperature difference, 90%-final boiling point distilled temperature difference, or final boiling point, it was considered hard to treat. Based on the evaluation parameters and the data in Tables 4 and 5, fuels 2 through 14 are considered hard to treat, and fuel 1 is considered normal. As the following examples demonstrate, the cold flow additives of the invention have beneficial effects when used with both normal and hard-to-treat fuels.

EXAMPLE 1

To evaluate the effect of the additive components individually on the cold filter plugging point (CFPP) of a fuel, two ethylene vinyl acetate isobutylene terpolymers identified as Terpolymers I and II in Table 3; two ethylene vinyl acetate copolymers identified in Table 3 as Copolymers I and II; alkyl phenol I as described in Table 2; alkyl phenol II as described in Table 2; and Imide I and Maleic Copolymer I from Table 1 were combined with Fuel 1 and tested according to test IP 309. The test results at an additive concentration of 250 ppm are set out below in Table 6. Unless as otherwise indicated, all concentration values are calculated by weight of the fuel.

TABLE 6

| Fuel | Additive | CFPP (° C.) |
|---|---|---|
| 1 | — | −11 |
| 1 | Copolymer II | −27 |
| 1 | Terpolymer I | −28.5 |
| 1 | Terpolymer II | −29 |
| 1 | Copolymer I | −30 |
| 1 | Alkyl Phenol I | −14 |
| 1 | Alkyl Phenol II | −19 |
| 1 | Imide I | −13 |
| 1 | Maleic Copolymer I | −16 |

Incorporation of any of Terpolymers I and II or Copolymers I and II resulted in a substantial improvement over the unmodified fuel, and also over fuel treated with either alkyl phenol, imide or maleic copolymer alone. A substantial improvement in CFPP was observed by the use of the longer carbon number Alkyl Phenol II relative to Alkyl Phenol I.

EXAMPLE 2

To evaluate the effect on CFPP of combining the terpolymer with one additional additive component, Terpolymer I was combined with an alkyl phenol, maleic anhydride α-olefin copolymer or its imide at various concentrations. The specific components, their concentrations and the CFPP improvement are set out in Table 7.

TABLE 7

| Fuel | Additive Combination: Additive 1 | Additive 2 | CFPP (° C.) |
|---|---|---|---|
| 1 | — | — | −11 |
| 1 | 250 ppm Terpolymer I | — | −28.5 |
| 1 | 237.5 ppm Terpolymer I | 12.5 ppm Alkyl Phenol I | −30 |
| 1 | 225 ppm Terpolymer I | 25 ppm Alkyl Phenol I | −26 |
| 1 | 215 ppm Terpolymer I | 35 ppm Alkyl Phenol I | −25 |
| 1 | 225 ppm Terpolymer I | 25 ppm Alkyl Phenol II | −32 |
| 1 | 225 ppm Terpolymer I | 25 ppm Maleic Copolymer I | −33 |
| 1 | 225 ppm Terpolymer I | 25 ppm Maleic Copolymer II | −24 |
| 1 | 225 ppm Terpolymer I | 25 ppm Maleic Copolymer III | −30 |

A small quantity of Alkyl Phenol I combined with Terpolymer I provides CFPP improvement relative to Terpolymer I, while higher concentrations of Alkyl Phenol I combined with Terpolymer I provided CFPP results worse than Terpolymer I alone. Alkyl Phenol II with Terpolymer I provided improved results relative to the combination of Terpolymer I and Alkyl Phenol I. Maleic Copolymer I combined with Terpolymer I provided the best CFPP results relative to combinations incorporating Maleic Copolymers II or III.

EXAMPLE 3

In another evaluation of the improvement of CFPP values by the combination of a maleic anhydride α-olefin copolymer or its imide with terpolymer or copolymer, the combinations listed below were formulated and tested on a variety of fuels. Table 8 below provides the results of an additive combination study utilizing Terpolymer I. Table 9 below provides the results of an additive combination study utilizing Copolymer I. A positive number in the right column indicates the additive combination produced a lower, and thus improved, CFPP relative to the terpolymer or copolymer without the second additive component.

TABLE 8

| Fuel | Additive (225 ppm Terpolymer I + _) | CFPP (° C.) Improvement Over 250 ppm Terpolymer I |
|---|---|---|
| 2 | 25 ppm Maleic Copolymer I | 3 |
| 3 | 25 ppm Maleic Copolymer I | 1 |
| 4 | 25 ppm Maleic Copolymer I | 1 |
| 5 | 25 ppm Maleic Copolymer I | 10 |
| 6 | 25 ppm Maleic Copolymer I | 4 |
| 7 | 25 ppm Maleic Copolymer I | 3 |
| 8 | 25 ppm Maleic Copolymer I | 2 |
| 9 | 25 ppm Maleic Copolymer I | 5 |
| 2 | 25 ppm Imide I | 1 |
| 3 | 25 ppm Imide I | 2 |
| 4 | 25 ppm Imide I | 5 |
| 5 | 25 ppm Imide I | 1 |
| 6 | 25 ppm Imide I | 2 |
| 7 | 25 ppm Imide I | 1 |
| 8 | 25 ppm Imide I | 2 |
| 9 | 25 ppm Imide I | 5 |

TABLE 9

| Fuel | Additive (225 ppm Copolymer I + _) | CFPP (° C.) Improvement Over 250 ppm Copolymer I |
|---|---|---|
| 2 | 25 ppm Maleic Copolymer I | −2 |
| 3 | 25 ppm Maleic Copolymer I | −1 |
| 4 | 25 ppm Maleic Copolymer I | −1 |
| 5 | 25 ppm Maleic Copolymer I | 1 |
| 6 | 25 ppm Maleic Copolymer I | 0 |
| 7 | 25 ppm Maleic Copolymer I | −2 |
| 8 | 25 ppm Maleic Copolymer I | −1 |
| 9 | 25 ppm Maleic Copolymer I | −2 |
| 2 | 25 ppm Imide I | 2 |
| 3 | 25 ppm Imide I | 2 |
| 4 | 25 ppm Imide I | 2 |
| 5 | 25 ppm Imide I | 1 |
| 6 | 25 ppm Imide I | 3 |
| 7 | 25 ppm Imide I | 4 |
| 8 | 25 ppm Imide I | 2 |
| 9 | 25 ppm Imide I | 0 |

Tables 8 and 9 demonstrate that the combination of either the maleic anhydride α-olefin copolymer or its imide with terpolymer results in a net improvement in CFPP performance over a wide range of hard-to-treat fuels relative to the use of terpolymer alone. However, though Copolymer I provided a significant improvement in CFPP relative to unmodified fuel as shown in Table 6 above, the combination of Copolymer I with maleic anhydride α-olefin copolymer had an adverse effect on CFPP for nearly all fuels tested.

EXAMPLE 4

In an attempt to further improve the CFPP values for fuels treated with a two component combination of terpolymer with maleic copolymer or alkyl phenol alone, additive combinations incorporating a third component were prepared, mixed with fuel and tested. The results of this evaluation, the combinations of additive components used in conducting the evaluation, and component concentrations are provided in Table 10 below. For comparison, CFPP results of two-additive component combinations are also provided. The results are arranged by improved CFPP performance.

TABLE 10

| Fuel | Additive Combination: Component I | Component II | Component III | CFPP (° C.) |
|---|---|---|---|---|
| 1 | — | — | — | −11 |
| 1 | 225 ppm Terpolymer I | 25 ppm Maleic Copolymer II | — | −24 |
| 1 | 225 ppm Terpolymer I | 25 ppm Alkyl Phenol I | — | −26 |
| 1 | 225 ppm Terpolymer I | 15 ppm Alkyl Phenol I | 10 ppm Maleic Copolymer III | −28 |
| 1 | 250 ppm Terpolymer I | — | — | −28.5 |
| 1 | 225 ppm Terpolymer I | 25 ppm Maleic Copolymer III | — | −30 |
| 1 | 225 ppm Terpolymer I | 15 ppm Alkyl Phenol I | 10 ppm Maleic Copolymer II | −31 |
| 1 | 225 ppm Terpolymer I | 20 ppm Alkyl Phenol I | 5 ppm Maleic Copolymer I | −31 |
| 1 | 225 ppm Terpolymer I | 25 ppm Alkyl Phenol II | — | −32 |
| 1 | 225 ppm Terpolymer I | 25 ppm Maleic Copolymer I | — | −33 |
| 1 | 225 ppm Terpolymer I | 10 ppm Alkyl Phenol I | 15 ppm Maleic Copolymer I | −33 |

TABLE 10-continued

| Fuel | Additive Combination: Component I | Component II | Component III | CFPP (° C.) |
|---|---|---|---|---|
| 1 | 225 ppm Terpolymer I | 5 ppm Alkyl Phenol II | 20 ppm Maleic Copolymer I | −34 |
| 1 | 225 ppm Terpolymer I | 15 ppm Alkyl Phenol I | 10 ppm Maleic Copolymer I | −36.5 |
| 1 | 225 ppm Terpolymer I | 10 ppm Alkyl Phenol II | 15 ppm Maleic Copolymer I | −37 |
| 1 | 225 ppm Terpolymer I | 15 ppm Alkyl Phenol II | 10 ppm Maleic Copolymer I | −37 |
| 1 | 225 ppm Terpolymer I | 20 ppm Alkyl Phenol II | 5 ppm Maleic Copolymer I | −39.5 |

A substantial improvement in CFPP performance resulted from specific combinations of terpolymer, maleic copolymer I and alkyl phenol I or II relative to the best previously tested two-component combination, 225 ppm Terpolymer I and 25 ppm Maleic Copolymer I.

EXAMPLE 5

CFPP improvement using an additive combination at a lower total concentration of 200 ppm was also evaluated. The effect of combining four individual additive components was also evaluated. The components, their concentrations and the CFPP improvement are provided below in Table 11.

TABLE 11

| Fuel | Additive Combination: Component I | Component II | Component III | Component IV | CFPP (° C.) |
|---|---|---|---|---|---|
| 1 | — | — | — | — | −11 |
| 1 | 200 ppm Terpolymer I | — | — | — | −26 |
| 1 | 180 ppm Terpolymer I | 4 ppm Alkyl Phenol I | 16 ppm Alkyl Phenol II | — | −29 |
| 1 | 180 ppm Terpolymer I | 16 ppm Alkyl Phenol II | 4 ppm Maleic Copolymer I | — | −33 |
| 1 | 180 ppm Terpolymer I | 4 ppm Alkyl Phenol I | 12 ppm Alkyl Phenol II | 4 ppm Maleic Copolymer I | −37 |

Even though the total additive concentration was decreased from 250 ppm to 200 ppm, substantial improvement is observed in CFPP performance relative to the unmodified fuel. The four-component combination in Table 11 at 200 ppm concentration resulted in CFPP performance of −37° C., compared to a CFPP of −39.5° C. for the best three-component combination at 250 ppm concentration in Table 10.

EXAMPLE 6

Additive combinations of terpolymer, alkyl phenol and maleic copolymer components were incorporated into two fuels considered hard to treat, and evaluated for CFPP improvement. For comparison, ethylene vinyl acetate copolymer was substituted for the terpolymer to evaluate CFPP performance. The CFPP improvement attributable to the terpolymer or copolymer alone is also listed. The components, their concentrations and the CFPP improvements are provided below in Table 12.

TABLE 12

| Fuel | Additive Combination: Component I | Component II | Component III | Component IV | CFPP (° C.) |
|---|---|---|---|---|---|
| 6 | — | — | — | — | −16 |
| 6 | 250 ppm Copolymer I | — | — | — | −19 |
| 6 | 250 ppm Terpolymer I | — | — | — | −19 |
| 1 | 225 ppm Copolymer I | 5 ppm Alkyl Phenol I | 15 ppm Alkyl Phenol II | 5 ppm Maleic Copolymer I | −22 |
| 6 | 225 ppm Terpolymer I | 5 ppm Alkyl Phenol I | 15 ppm Alkyl Phenol II | 5 ppm Maleic Copolymer I | −28 |
| 14 | — | — | — | — | −26 |
| 14 | 250 Copolymer I | — | — | — | −29 |
| 14 | 250 ppm Terpolymer I | — | — | — | −31 |
| 14 | 225 ppm Copolymer I | 5 ppm Alkyl Phenol I | 15 ppm Alkyl Phenol II | 5 ppm Maleic Copolymer I | −27 |
| 14 | 225 ppm Terpolymer I | 5 ppm Alkyl Phenol I | 15 ppm Alkyl Phenol II | 5 ppm Maleic Copolymer I | −35 |

Though the CFPP for the fuels containing only Copolymer I or Terpolymer I is the same when testing fuel 6, and only 2° C. different when testing fuel 14, the effect of incorporating Alkyl Phenol I, Alkyl Phenol II, and Maleic Copolymer I with Terpolymer I on CFPP was substantially greater than the same combination of additive components with Copolymer I. In fact, the incorporation of Alkyl Phenol I, Alkyl Phenol II and Maleic Copolymer I with Copolymer I had an adverse effect on the CFPP performance relative to Copolymer I alone in fuel 14.

EXAMPLE 7

As demonstrated in previous examples, incorporation of an ethylene vinyl acetate copolymer into the additive combination has provided mixed results relative to CFPP improvements and has generally provided less of an improvement as compared with ethylene vinyl acetate isobutylene terpolymer. Unexpectedly it has been found that incorporation of a small quantity of copolymer with terpolymer in combination with other additive components provides excellent CFPP improvement. Included in this evaluation was a second terpolymer identified as Terpolymer II in Table 3 above. Also included in this evaluation was a second copolymer identified in Table 3 as Copolymer II. For comparison, combinations of fewer additive components are included to demonstrate the improvement by incorporating additional components. The components, their concentrations, and the CFPP improvement are provided below in Table 13. All testing was conducted using Fuel 1. The total additive concentration by weight was limited to 200 ppm.

TABLE 13

| Additive Combination | | | | | | | |
|---|---|---|---|---|---|---|---|
| Component 1 | Component 2 | Component 3 | Component 4 | Component 5 | Component 6 | Component 7 | CFPP (° C.) |
| — | — | — | — | — | — | — | −11 |
| 200 ppm Terpolymer I | — | — | — | — | — | — | −26 |
| 180 ppm Terpolymer I | 20 ppm Alkyl Phenol II | — | — | — | — | — | −28 |
| 140 ppm Terpolymer I | 46 ppm Copolymer I | 14 ppm Alkyl Phenol II | — | — | — | — | −30 |
| 180 ppm Terpolymer I | 10 ppm Copolymer II | 10 ppm Alkyl Phenol II | — | — | — | — | −31 |
| 140 ppm Terpolymer I | 40 ppm Copolymer II | 20 ppm Alkyl Phenol II | — | — | — | — | −32 |
| 140 ppm Terpolymer I | 48 ppm Copolymer I | 10 ppm Alkyl Phenol II | 2 ppm Alkyl Phenol I | — | — | — | −33 |
| 140 ppm Terpolymer I | 40 ppm Copolymer I | 14 ppm Alkyl Phenol II | 6 ppm Alkyl Phenol 1 | — | — | — | −33 |
| 180 ppm Terpolymer I | 10 ppm Alkyl Phenol II | 6 ppm Alkyl Phenol I | 4 ppm Maleic Copolymer I | — | — | — | −35 |
| 100 ppm Terpolymer II | 40 ppm Terpolymer I | 44 ppm Copolymer I | 10 ppm Alkyl Phenol II | 6 ppm Alkyl Phenol I | — | — | −37 |
| 180 ppm Terpolymer I | 16 ppm Alkyl Phenol II | 4 ppm Maleic Copolymer I | — | — | — | — | −37 |
| 140 ppm Terpolymer I | 22 ppm Copolymer I | 22 ppm Copolymer II | 10 ppm Alkyl Phenol II | 6 ppm Maleic Copolymer I | — | — | −38 |
| 140 ppm Terpolymer I | 40 ppm Copolymer II | 10 ppm Alkyl Phenol II | 4 ppm Alkyl Phenol I | 6 ppm Maleic Copolymer I | — | — | −39 |
| 90 ppm Terpolymer I | 50 ppm Terpolymer II | 40 ppm Copolymer I | 10 ppm Alkyl Phenol II | 6 ppm Alkyl Phenol I | 4 ppm Maleic Copolymer I | — | −39 |
| 100 ppm Terpolymer II | 40 ppm Terpolymer I | 44 ppm Copolymer II | 10 ppm Alkyl Phenol II | 6 ppm Maleic Copolymer I | — | — | −39 |
| 94 ppm Terpolymer I | 76 ppm Terpolymer II | 6 ppm Copolymer I | 6 ppm Copolymer II | 10 ppm Alkyl Phenol II | 4 ppm Alkyl Phenol I | 4 ppm Maleic Copolymer I | −40 |
| 100 ppm Terpolymer II | 60 ppm Terpolymer I | 20 ppm Copolymer I | 10 ppm Alkyl Phenol II | 4 ppm Alkyl Phenol I | 6 ppm Maleic Copolymer I | — | −41 |
| 140 ppm Terpolymer I | 40 ppm Copolymer I | 14 ppm Alkyl Phenol II | 6 ppm Maleic Copolymer I | — | — | — | −45 |

Best results were obtained with an additive combination of terpolymer with at least one each of copolymer, alkyl phenol and maleic anhydride α-olefin copolymer components.

EXAMPLE 8

A study was also conducted on the effect of adjusting the concentration of the additive combination on the CFPP. The study was conducted on three fuels, and evaluated unmodified fuel, fuel with Terpolymer I only, and fuel with Terpolymer I, Copolymer I, Alkyl Phenol II and Maleic Copolymer I. The components, their concentrations and the CFPP improvement for each of the runs are provided below in Table 14.

TABLE 14

| Fuel | Additive Combination | Concentration of Combination (ppm) | CFPP (° C.) |
|---|---|---|---|
| 1 | — | — | −11 |
| 1 | Terpolymer I | 50 | −15 |
| 1 | Terpolymer I | 200 | −26 |
| 1 | 70% Terpolymer I; 20% Copolymer I; | 50 | −31 |
| 1 | 7% Alkyl Phenol II; 3% Maleic Copolymer I | 200 | −45 |
| 9 | — | — | −19 |
| 9 | Terpolymer I | 50 | −22 |
| 9 | Terpolymer I | 150 | −31 |
| 9 | Terpolymer I | 250 | −35 |

TABLE 14-continued

| Fuel | Additive Combination | Concentration of Combination (ppm) | CFPP (° C.) |
|---|---|---|---|
| 9 | 70% Terpolymer I; 20% Copolymer I; | 50 | −28 |
| 9 | 7% Alkyl Phenol II: 3% Maleic Copolymer I | 150 | −40 |
| 12 | — | — | −9 |
| 12 | Terpolymer I | 250 | −11 |
| 12 | Terpolymer I | 500 | −15 |
| 12 | 70% Terpolymer I; 20% Copolymer I; 7% Alkyl Phenol II; 3% Maleic Copolymer I | 200 | −14 |

In each of the above evaluations, incorporation of the multi-component additive combination of the invention produced CFPP results which were superior to unmodified fuel. CFPP results were obtained from the multi-component additive combinations at low use concentrations which were similar to results based on Terpolymer I alone at substantially higher use concentrations.

EXAMPLE 9

Another aspect of distillate fuel cold flow performance involves the pour point of the fuel. Evaluation of the pour point depression (PPD) of a fuel after treatment with an additive combination is conducted utilizing ASTM D 97, incorporated herein by reference. A variety of fuels were individually treated with the combination of either a maleic anhydride α-olefin copolymer or its imide with either terpolymer or copolymer. These combinations are listed below. Table 15 provides the results of an additive combination study utilizing Terpolymer I. Table 16 provides the results of an additive combination study utilizing Copolymer I. A positive number in the right column indicates that the additive combination produced a lower pour point than the terpolymer or copolymer without the second additive component.

TABLE 15

| Fuel | Additive (225 ppm Terpolymer I + __) | Pour Point Improvement Over 250 ppm Terpolymer I |
|---|---|---|
| 10 | 25 ppm Maleic Copolymer I | 8 |
| 11 | 25 ppm Maleic Copolymer I | 6 |
| 12 | 25 ppm Maleic Copolymer I | 10 |
| 13 | 25 ppm Maleic Copolymer I | 6 |
| 10 | 25 ppm Imide I | 16 |
| 11 | 25 ppm Imide I | 4 |
| 12 | 25 ppm Imide I | 6 |
| 13 | 25 ppm Imide I | 6 |

TABLE 16

| Fuel | Additive (225 ppm Copolymer I + __) | Pour Point Improvement Over 250 ppm Copolymer I |
|---|---|---|
| 10 | 25 ppm Maleic Copolymer I | 2 |
| 11 | 25 ppm Maleic Copolymer I | 6 |
| 12 | 25 ppm Maleic Copolymer I | 4 |
| 13 | 25 ppm Maleic Copolymer I | 6 |
| 10 | 25 ppm Imide I | 8 |
| 11 | 25 ppm Imide I | 2 |
| 12 | 25 ppm Imide I | 2 |
| 13 | 25 ppm Imide I | 2 |

Tables 15 and 16 demonstrate that the combination of either the maleic anhydride α-olefin copolymer or its imide with either terpolymer or copolymer results in PPD improvement over a range of fuels relative to incorporation of the terpolymer or copolymer alone into the fuel.

As the above examples demonstrate, the additive combinations of the invention provide substantial improvements in cold flow properties of distillate fuels relative to the unmodified fuel. By incorporating selected additional additive components into the combination while maintaining a constant concentration, the cold flow properties such as cold filter plugging point and pour point depression are further improved. The improvement in cold flow properties extends to both normal and hard-to-treat fuels.

Other modifications and variations of the present invention are possible in light of the above teachings. Changes may be made in the particular embodiments of the invention which are within the full intended scope of the invention as defined by the appended claims.

What is claimed:

1. A distillate fuel composition having improved cold flow properties comprising a major proportion of a distillate fuel and an additive combination in an amount effective to improve cold flow properties; wherein the additive combination comprises an ethylene vinyl acetate isobutylene terpolymer and a maleic anhydride α-olefin copolymer component having the structure:

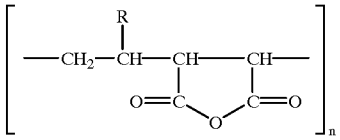

wherein R is a hydrocarbon substituent and at least 60% by weight of R is $C_{16}$ to $C_{40}$, and n is from about 2 to about 8.

2. The composition of claim 1 wherein at least 70% by weight of R is $C_{16}$ to $C_{40}$.

3. The composition of claim 1 wherein at least 80% by weight of R is $C_{16}$ to $C_{40}$.

4. The composition of claim 1 wherein at least 60% by weight of R is $C_{22}$ to $C_{38}$.

5. The composition of claim 1 wherein at least 70% by weight of R is $C_{22}$ to $C_{38}$.

6. The composition of claim 1 wherein at least 80% by weight of R is $C_{22}$ to $C_{38}$.

7. The composition of claim 1 wherein the maleic anhydride α-olefin copolymer has a number average molecular weight within the range of about 1,000 to about 5,000.

8. The composition of claim 1 wherein the ethylene vinyl acetate isobutylene terpolymer has a weight average molecular weight from about 1,500 to about 18,000, a number average molecular weight from about 400 to about 3,000, a ratio of weight average molecular weight to number average molecular weight from about 1.5 to about 6, and a vinyl acetate content from about 25 to about 55 weight percent.

9. The composition of claim 8 wherein the terpolymer has a weight average molecular weight from about 3,000 to about 12,000 and a number average molecular weight from about 1,500 to about 2,500.

10. The composition of claim 1 which contains from about 10 to about 1,000 ppm of said terpolymer.

11. The composition of claim 1 wherein said distillate fuel is a middle distillate fuel.

12. The composition of claim 1 wherein said distillate fuel is No. 2 diesel fuel.

13. The composition of claim 1 wherein said distillate fuel is hard-to-treat fuel.

14. The composition of claim 1 wherein said maleic anhydride α-olefin copolymer component is derived from substantially equimolar proportions of maleic anhydride and α-olefin.

15. A distillate fuel composition having improved cold flow properties comprising a major proportion of a distillate fuel and an additive combination in an amount effective to improve cold flow properties; wherein the additive combination comprises an ethylene vinyl acetate isobutylene terpolymer and an imide component having the structure:

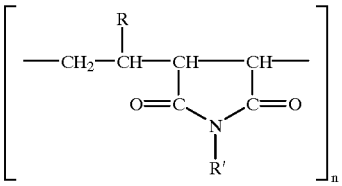

wherein R and R' are hydrocarbon substituents; at least 60% by weight of R is $C_{20}$ to $C_{40}$; at least 80% by weight of R' is $C_{16}$ to $C_{18}$, and n is from about 2 to about 8.

16. A distillate fuel composition having improved cold flow properties comprising a major proportion of a distillate fuel and an additive combination in an amount effective to improve cold flow properties; wherein the additive combination comprises:

(A) an ethylene vinyl acetate isobutylene terpolymer; and (B) an alkyl phenol component having the structure:

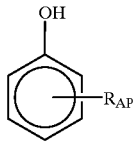

wherein $R_{AP}$ is a hydrocarbon substituent and at least 70% by weight of $R_{AP}$ is $C_{20}$ to $C_{28}$.

17. A distillate fuel composition having improved cold flow properties comprising a major proportion of a distillate fuel and an additive combination in an amount effective to improve cold flow properties; wherein the additive combination comprises:

(A) an ethylene vinyl acetate isobutylene terpolymer;

(B) a maleic anhydride α-olefin copolymer component having the structure:

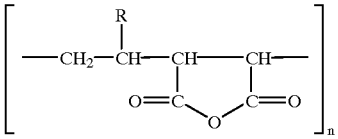

wherein R is a hydrocarbon substituent and at least 60% by weight of R is $C_{16}$ to $C_{40}$, and n is from about 2 to about 8; and (C) an alkyl phenol component having the structure:

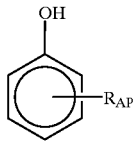

wherein $R_{AP}$ is a hydrocarbon substituent and at least 70% by weight of $R_{AP}$ is $C_{20}$ to $C_{28}$.

18. A distillate fuel composition having improved cold flow properties comprising a major proportion of a distillate fuel and an additive combination in an amount effective to improve cold flow properties; wherein the additive combination comprises:

(A) an ethylene vinyl acetate isobutylene terpolymer;

(B) a maleic anhydride α-olefin copolymer component having the structure:

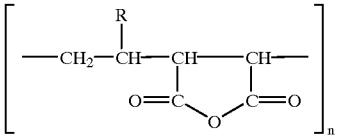

wherein R is a hydrocarbon substituent and at least 60% by weight of R is $C_{16}$ to $C_{40}$, and n is from about 2 to about 8;

(C) an alkyl phenol component having the structure:

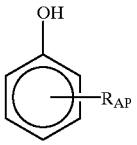

wherein $R_{AP}$ is a hydrocarbon substituent and at least 70% by weight of $R_{AP}$ is $C_{20}$ to $C_{28}$; and (D) an ethylene vinyl acetate copolymer component.

19. The composition of claim 18 wherein said maleic anhydride α-olefin copolymer component is derived from substantially equimolar proportions of maleic anhydride and α-olefin.

20. An additive combination for improving the cold flow properties of a distillate fuel, said additive combination comprising an ethylene vinyl acetate isobutylene terpolymer and a maleic anhydride α-olefin copolymer component having the structure:

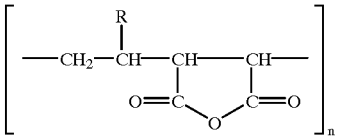

wherein R is a hydrocarbon substituent and at least 60% by weight of R is $C_{16}$ to $C_{40}$, n is from about 2 to about 8.

21. The additive combination of claim 20 further comprising an alkyl phenol component having the structure:

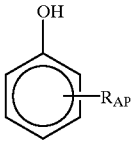

wherein $R_{AP}$ is a hydrocarbon substituent and at least 70% by weight of $R_{AP}$ is $C_{20}$ to $C_{28}$.

22. The additive combination of claim 21 further comprising an ethylene vinyl acetate copolymer component.

23. An additive combination for improving cold flow properties of a distillate fuel, said additive combination comprising an ethylene vinyl acetate isobutylene terpolymer and an imide component having the structure:

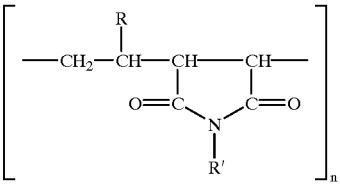

wherein R and R' are hydrocarbon substituents; at least 60% by weight of R is $C_{20}$ to $C_{40}$; at least 80% by weight of R' is $C_{16}$ to $C_{18}$; and n is from about 2 to about 8.

24. An additive combination for improving the cold flow properties of a distillate fuel, said additive combination comprising an ethylene vinyl acetate isobutylene terpolymer and an alkyl phenol component having the structure:
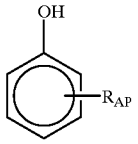
wherein $R_{AP}$ is a hydrocarbon substituent and at least 70% by weight of $R_{AP}$ is $C_{20}$ to $C_{28}$.
25. The additive combination of claim 24 further comprising an ethylene vinyl acetate copolymer component.
* * * * *